US005497177A

United States Patent [19]

Björkengren

[11] Patent Number: 5,497,177

[45] Date of Patent: Mar. 5, 1996

[54] COMPENSATION FOR CROSSTALK BETWEEN CHANNELS OF AN INK JET PRINTER

[75] Inventor: Ulf Björkengren, Lund, Sweden

[73] Assignee: Plotcon HB, Lund, Sweden

[21] Appl. No.: 856,037

[22] PCT Filed: Nov. 13, 1990

[86] PCT No.: PCT/SE90/00729

§ 371 Date: May 11, 1992

§ 102(e) Date: May 11, 1992

[87] PCT Pub. No.: WO91/07283

PCT Pub. Date: May 30, 1991

[30] Foreign Application Priority Data

Nov. 14, 1989 [SE] Sweden ..... 8903819

[51] Int. Cl.[6] ..... B41J 2/085

[52] U.S. Cl. ..... 347/76; 347/78; 347/94

[58] Field of Search ..... 347/94, 12, 6, 347/76, 78

[56] References Cited

U.S. PATENT DOCUMENTS

| | | | |
|---|---|---|---|
| 4,074,278 | 2/1978 | Robertson | 347/76 |
| 4,215,354 | 7/1980 | Larsson | 347/94 |
| 4,251,823 | 2/1981 | Sagae | 347/94 X |
| 4,344,079 | 8/1982 | Chambors et al. | 347/12 |
| 4,381,515 | 4/1983 | Bain | 347/94 X |
| 4,419,674 | 12/1983 | Bahl et al. | 347/76 |
| 4,427,986 | 1/1984 | Iyoda et al. | 347/76 |
| 4,788,557 | 11/1988 | Howkins | 347/94 X |
| 4,965,608 | 10/1990 | Shinohara et al. | 347/12 |
| 5,142,296 | 8/1992 | Lopez et al. | 347/12 |
| 5,266,965 | 11/1993 | Komai et al. | 347/12 |

FOREIGN PATENT DOCUMENTS

| | | | |
|---|---|---|---|
| 0098094 | 1/1984 | European Pat. Off. . | |
| 2756805 | 10/1981 | Germany . | |
| 5-069544 | 3/1993 | Japan | 347/12 |

OTHER PUBLICATIONS

Fillmore et al., "Charge Compensation Scheme for Array Ink Jets", IBM Technical Disclosure Bulletin, vol. 20, No. 11B, Apr. 1978, p. 4710.

Nguyen, N. N., "Storing and Retrieving Data Bases in Ink Jet Printers", *IBM Technical Disclosure Bulletin,* vol. 21, No. 2 (1978) pp. 721–723.

Mix, A. L., "Charge Electrode Alignment and Retraction", *IBM Technical Disclosure Bulletin,* vol. 20, No. 1 (1977) pp. 33–34.

Krause, K. A., "Ink Jet Head", *IBM Technical Disclosure Bulletin,* vol. 19, No. 8 (1977), pp. 3216–3217.

*Primary Examiner*—A. T. Grimley
*Assistant Examiner*—Shuk Y. Lee
*Attorney, Agent, or Firm*—Shapiro and Shapiro

[57] ABSTRACT

The invention relates to a method of compensating for crosstalk between adjacent charging electrodes (14) in an ink jet printer having multiple printing jets (12) or channels, each with one charging electrode (14). In order to provide a desired drop charge in a specific channel X, there is applied, to the corresponding charging electrode ($\mathbf{14}_X$), a charge potential $V_X$ which is compensated for in response to (i) any charge potentials $V_{X-1}$ and $V_{X+1}$ applied to charging electrodes ($\mathbf{14}_{X-1}$, $\mathbf{14}_{X+1}$) of the nearest channel X–1 and X+1, respectively, on each side of the specific channel X, and (ii) in response also to at least charge potentials $V_{X-2}$ and $V_{X+2}$ applied to charging electrodes ($\mathbf{14}_{X-2}$, $\mathbf{14}_{X+2}$) of the next nearest channel X–2 and X+2, respectively, on each side of the specific channel X. The compensation is achieved by selecting $V_X$ as equalling a value V(I) associated with a charge situation I at issue and included in a matrix of compensated predetermined potential values compiled by an iterative, or equivalent, technique.

7 Claims, 6 Drawing Sheets

COMPENSATION FOR CROSSTALK BETWEEN CHANNELS OF AN INK JET PRINTER

The present invention relates generally to ink jet printers with multiple ink jets or channels. More particularly, the invention relates to a method of compensating for crosstalk between charging electrodes in such an ink jet printer.

In an ink jet printer, ink drops are applied to a printing surface to jointly form a picture, a text, etc. To provide such a print, ink jet printers with multiple continuous ink Jets have a printing head comprising a nozzle with a number of orifices distributed in one or more rows and communicating with a liquid container accommodating an electrically conductive liquid. The liquid is forced by pressure through each nozzle orifice in the form of separate continuous printing jets which are decomposed into drops, i.e. each printing jet is transformed into a drop train.

A multiple jet ink printer further comprises, immediately adjacent the drop formation point of each printing jet, a separate charging electrode associated with the printing jet and adapted to generate a charge field for selectively charging the drops of the corresponding drop train. Drop charge-controlling electrode potentials are applied selectively to each charging electrode to charge the drops when these are being formed at the drop formation points. In other words, each continuous printing jet is transformed into a drop train consisting of drops with selectively controlled charges.

The drop trains with their selectively charged drops pass from the drop formation points through a deflection field which is associated with the printer and in which charged drops are deflected and uncharged drops pass in undeflected paths. The printing surface, for example a paper on a rotating roller may be adapted, depending upon the printer construction, to receive either the undeflected or the deflected drops.

During start-up of an ink jet printer of this type, the pressure in the liquid container is increased for a short but by no means negligible time during which the paths of the printing jets and the drop trains are unpredictable and the drop formation process is not fully developed. This unstable function lasts until the correct operating pressure has been attained in the liquid container.

Conditions are essentially the same upon shut-down of the printer. When the pressure in the liquid container decreases and the liquid flow through the nozzle orifices is reduced, the printing jets and the drop trains become unstable and difficult to control.

During start-up and shut-down of an ink jet printer there is, therefore, a considerable risk that liquid will be deposited on the charging electrodes, causing physical obstacles to the printing jets and/or the drops, and this again may result in an erroneous text or no text at all. Also during normal operation, there may occur, for various reasons, an undesired deposition of drops on the charging electrodes. For the reasons stated below, this phenomenon is especially pronounced in multiple jet printers. In a system with multiple printing jets positioned relatively close to one another, the electric field from a charging electrode (the charge field) may affect the drop charge of several printing jets, besides the jet associated with that particular charging electrode, i.e. crosstalk between different channels may occur. To reduce such crosstalk, it is conventional to arrange the separate charging electrodes in the manner shown in FIG. 1 of the accompanying drawings. One such electrode structure is described in, for example, IBM Technical Disclosure Bulletin, Vol. 20, No. 1, June 1977 and IBM Technical Disclosure Bulletin, Vol. 19, No. 8, January 1977.

FIG. 1 shows a broken-away part of a charging electrode means 10 in an ink jet printing head with multiple printing jets 12. The electrode means 10 has, for each printing jet 12, a rectangular recess or slit in which a separate charging electrode 14 is formed. The shielded U profile thus imparted to each charging electrode 14 reduces the crosstalk between the separate charge fields. Furthermore, FIG. 1 illustrates schematically how a print signal 16 associated with each printing jet 12 and containing information about a desired drop charge in the printing jet is supplied to the respective charging electrode 14 via an amplifier 18.

With an electrode structure as shown in FIG. 1, the risk is considerable that already a few drops deposited on the charging electrodes may clog the relatively small slits and form physical obstacles to the jets 12.

To solve the problem of clogging, the above-mentioned IBM Technical Disclosure Bulletin, Vol. 20, No. 1, June 1977 proposes a charging electrode means which is movable in relation to the nozzle generating the printing jet. Upon start-up and shut-down, the charging electrode means is moved aside, such that uncontrolled printing jets and drops cannot be deposited on the charging electrodes. Similar constructions have been proposed for moving the deflection electrodes aside. In this manner, the undesired deposition of ink on the electrodes is avoided. However, moving the charging electrodes aside in this manner during start-up and shut-down is inadequate. For one thing, additional space is required in the printing head to accommodate the electrode means moved aside. Secondly, the movement of the charging electrodes may, in course of time, cause these electrodes to be incorrectly positioned in relation to the orifice plate and the drop formation points, resulting in an incorrect text. Thirdly, a movable electrode structure is more expensive to manufacture and requires more maintenance, and fourthly an undesired deposition of ink in the small slits may occur also during normal operation (i.e. between start-up and shut-down) of the electrode structure shown in FIG. 1.

The crosstalk problem has previously been discussed by Robertson in U.S. Pat. No. 4,074,278 which proposes a method of compensating for crosstalk between adjacent charging electrodes of an ink jet printer having multiple printing jets or channels, each with one charging electrode. More particularly, Robertson proposes, in order to provide in a specific channel X a drop charge suitable for printing, to apply to the corresponding charging electrode a charge potential $V_X$ which is compensated for in response to any charge potentials $V_{X-1}$ and/or $V_{X+1}$ being applied to charging electrodes of the nearest channel X−1 and X+1, respectively, on each side of the specific channel X.

Thus, U.S. Pat. No. 4,074,278 proposes (col. 4, lines 26–29), in order to obtain uncharged drops, i.e. drops providing a print, to selectively apply to the electrode of the specific channel X a potential of opposite polarity which is sufficient in magnitude to counteract the crosstalk effect. This known compensation technique can be explained by means of the Table below in which it is assumed that the printing function is normally controlled by switching the charge potential between $V_{charge}$ and 0 volt (both taken in relation to the potential of the ink), and in which k is a constant less than 1, which is dependent upon the amount of crosstalk in the printer at issue.

| $ELECTRODE_{X-1}$ | $ELECTRODE_X$ | $ELECTRODE_{X+1}$ |
|---|---|---|
| 0 | $-kV_{charge}$ | $+V_{charge}$ |
| $+V_{charge}$ | $-kV_{charge}$ | 0 |

-continued

| $ELECTRODE_{X-1}$ | $ELECTRODE_X$ | $ELECTRODE_{X+1}$ |
|---|---|---|
| $+V_{charge}$ | $-2kV_{charge}$ | $+V_{charge}$ |

To avoid confusion with other known technique in the field of ink jet printers, it should be observed that both U.S. Pat. No. 4,074,278 and the present invention are concerned with the compensation of channel-to-channel crosstalk, not with drop-to-drop crosstalk in a specific channel.

The compensation technique proposed by U.S. Pat. No. 4,074,278 is, as can be seen from FIG. 2 of this patent, intended to be used in conjunction with a slitted or U-shaped charging electrode structure as shown in FIG. 1 of the present application. As already mentioned, it is extremely difficult with such an electrode structure always to maintain the printing jets fully stable so that they will not strike the charging electrode structure. Only a few drops need to be deposited on the charging electrode surface to render the printing jet inoperative.

On the other hand, a planar charging electrode structure as shown in FIG. 2 of the accompanying drawings is far less sensitive to wrongly deposited drops, and also is easier to make. However, since such a planar charging electrode structure has no crosstalk shielding, the amount of crosstalk will nevertheless be so considerable that the compensation technique proposed by U.S. Pat. No. 4,074,278 does not suffice to give a compensation with adequate accuracy of the drop charges.

Therefore, there is need for a technique capable of producing an accurate and satisfactory compensation for charging electrode structures having intense crosstalk between adjacent channels.

The present invention meets this requirement and proposes, for this purpose, an improvement of the compensation technique described in U.S. Pat. No. 4,074,278. The distinctive features of the inventive method of compensating for crosstalk between channels are stated in the appended claims.

The inventive method of compensating for crosstalk gives a far better compensation than U.S. Pat. No. 4,074,278. The compensation according to the invention is so efficient that it becomes practically possible to use the type of planar charging electrode structures illustrated in the accompanying FIG. 2 in applications with a relatively small distance between printing jets, i.e. in applications with fairly considerable crosstalk.

A number of embodiments of the invention are described in more detail below, reference being had to the accompanying drawings.

Figure 2:
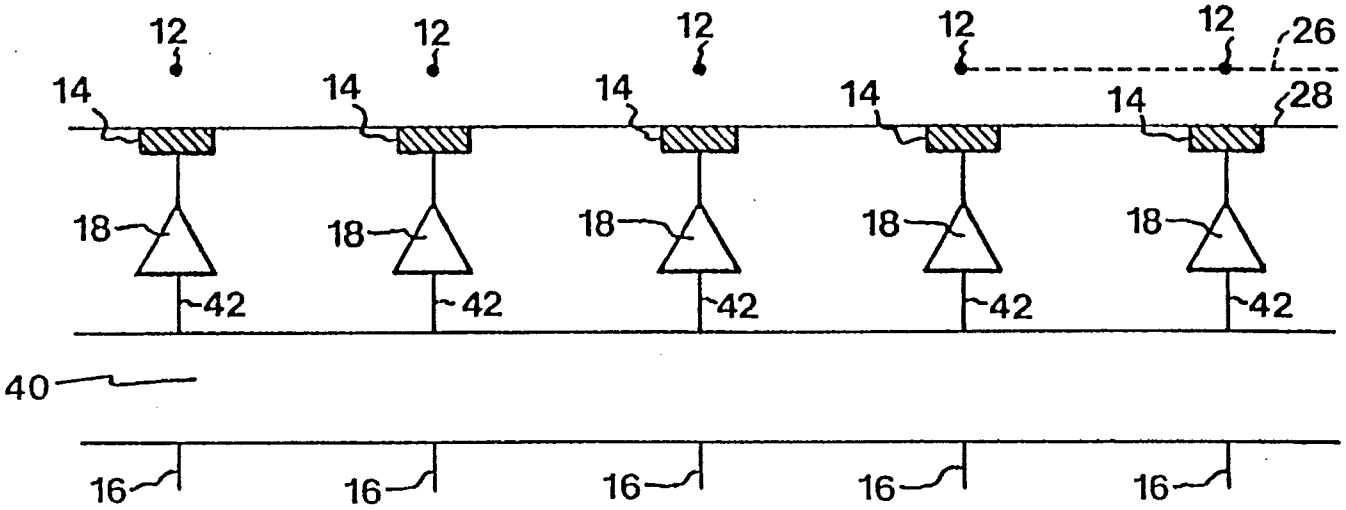
FIG. 2 is a broken-away schematic sectional view of a planar charging electrode structure and the associated compensation electronics.
Figure 6:
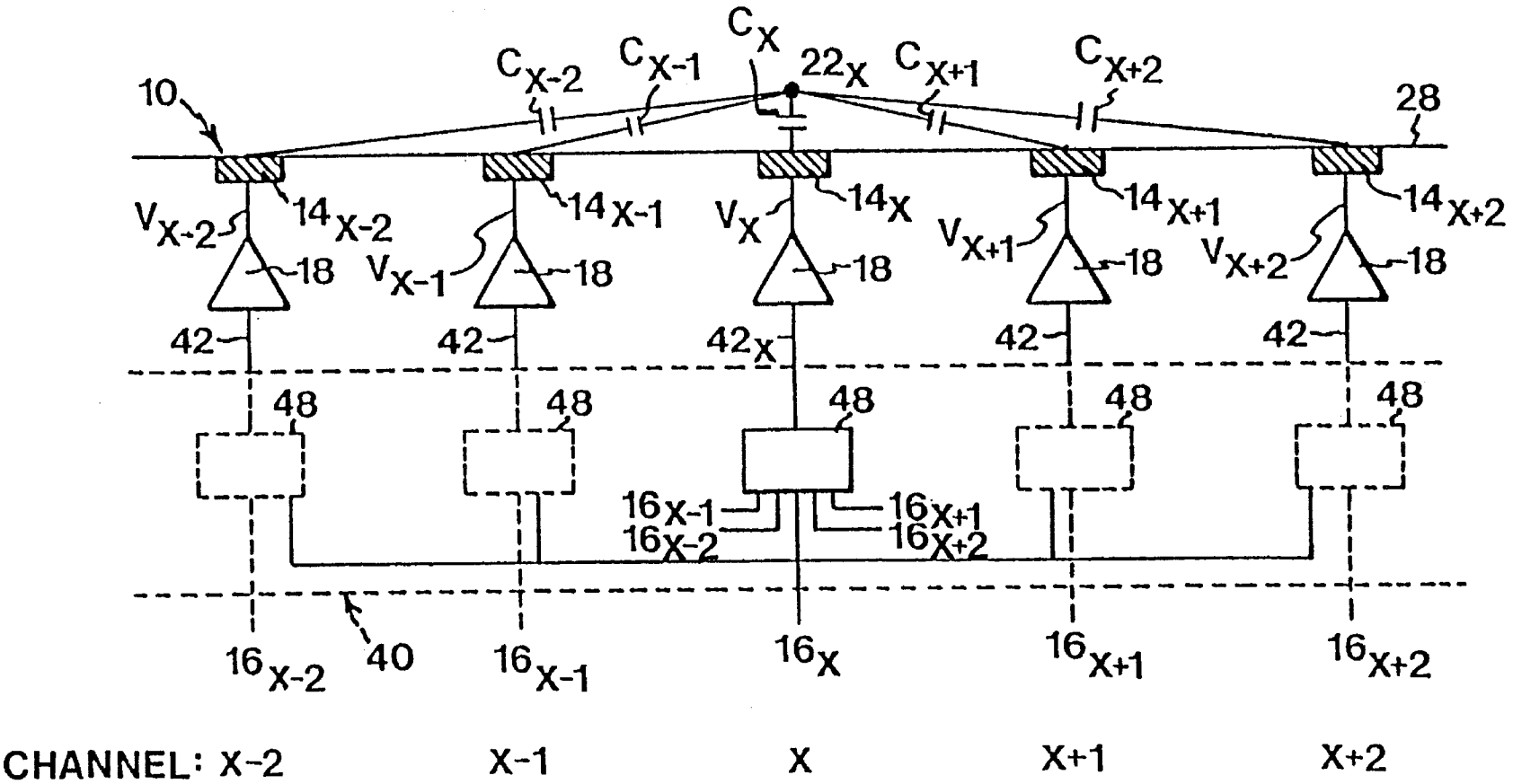
Figure 7:
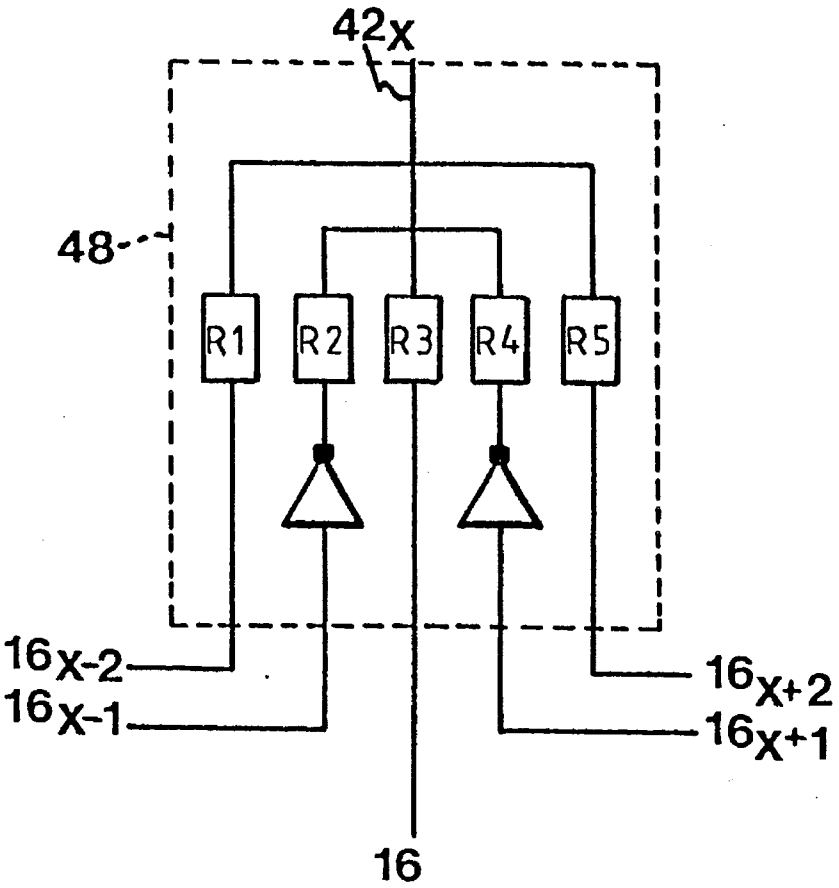
Figure 8:
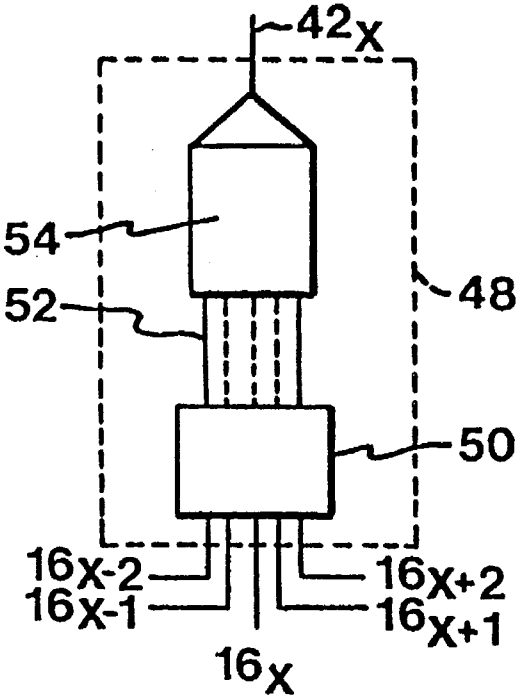

FIG. 6 corresponds to FIG. 2 and illustrates in block form the structure of a signal correction means;

FIG. 7 is an electric block diagram of a first method of realising the signal correction means of FIG. 6; and FIG. 8 illustrates a circuit solution for a second method of realising the signal correction means of FIG. 6.

Figure 1:
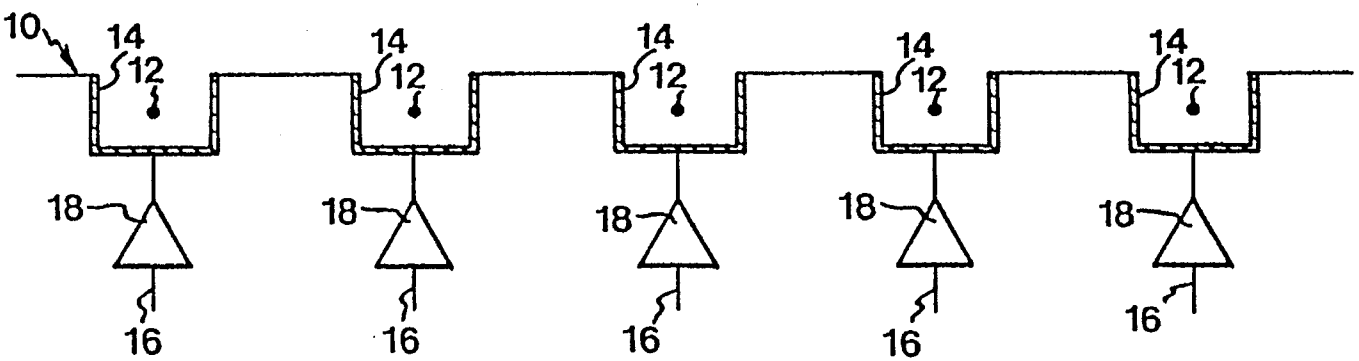
FIG.-1 PRIOR ART
FIG. 1 is a broken-away schematic view of a known slitted charging electrode structure.

The charging electrode means 10 of FIG. 1 with its separate charging electrodes 14 has been described above in conjunction with the prior art technique. In the following description, use is made, as far as possible, of the same reference numerals as in FIG. 1.

Figure 3:
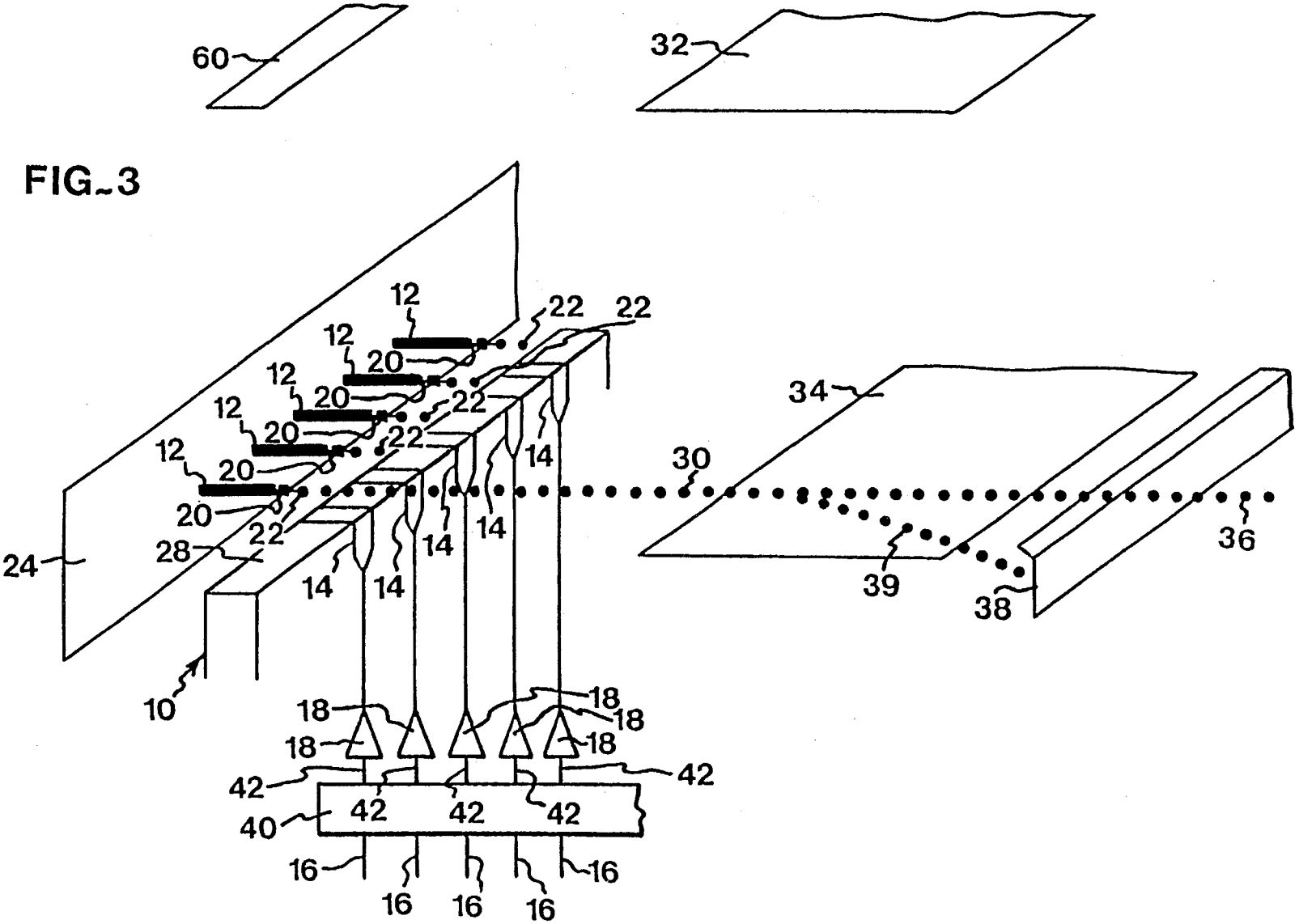
FIG. 3 is a schematic perspective view of a first embodiment of an ink jet printing head.

Reference is now made to FIG. 3 which illustrates a highly schematic perspective view of an ink jet printing head with multiple channels. The printing head comprises a drop formation means in the form of a plate 24 having a row of orifices (not shown) communicating with a liquid container (not shown) containing electrically conductive ink. The ink in the liquid container is of fixed potential. The orifices of the plate 24 divide the ink into a number of separate printing jets 12 which are divided, each at one drop formation point 20, into separate drops. Initially, the printing jets 12 are dispersed in a plane 26 perpendicular to the plate 24.

The printing head further comprises a charging electrode means 10 having a separate charging electrode 14 for each printing jet 12. The charging electrodes 14 lie in the immediate vicinity of the drop formation points 20 in a main surface 28 of the charging electrode means 10, parallel to the plane 26. As can be seen from the corresponding schematic sectional view of FIG. 2, the main surface 28 is at a distance from the plane 26, i.e. the charging electrodes 14 lie entirely outside the plane in which the printing jets 12 are dispersed.

The printing head of FIG. 3 is adapted to be supplied from outside with a printing signal 16 associated with each printing jet 12 and corresponding to the printing signals 16 in FIG. 1. On the basis of these printing signals 16, separate charge fields are generated at each charging electrode 14 for selectively charging the drops 22.

The drops 22 are dispersed in the form of drop trains, as shown by the dotted line 30, in between schematically shown deflection electrodes 32 and 34. Uncharged drops pass straight ahead through the deflection field, as shown at 36. Charged drops, on the other hand, are deflected in known manner and caught by a catching means 38, as indicated at 39.

The printing signals 16 are not directly supplied to the charging electrodes 14, as in FIG. 1. Instead, the printing signals 16 which are assumed to be binary signals, are supplied in parallel into a signal correction means 40 in which the printing signals 16 are processed in a predetermined manner to generate a corresponding number of output signals 42. After suitable amplification in amplifiers 18, there are obtained, on the basis of these output signals 42, charge-controlling electrode potentials which are applied each to one charging electrode 14.

Figure 4:
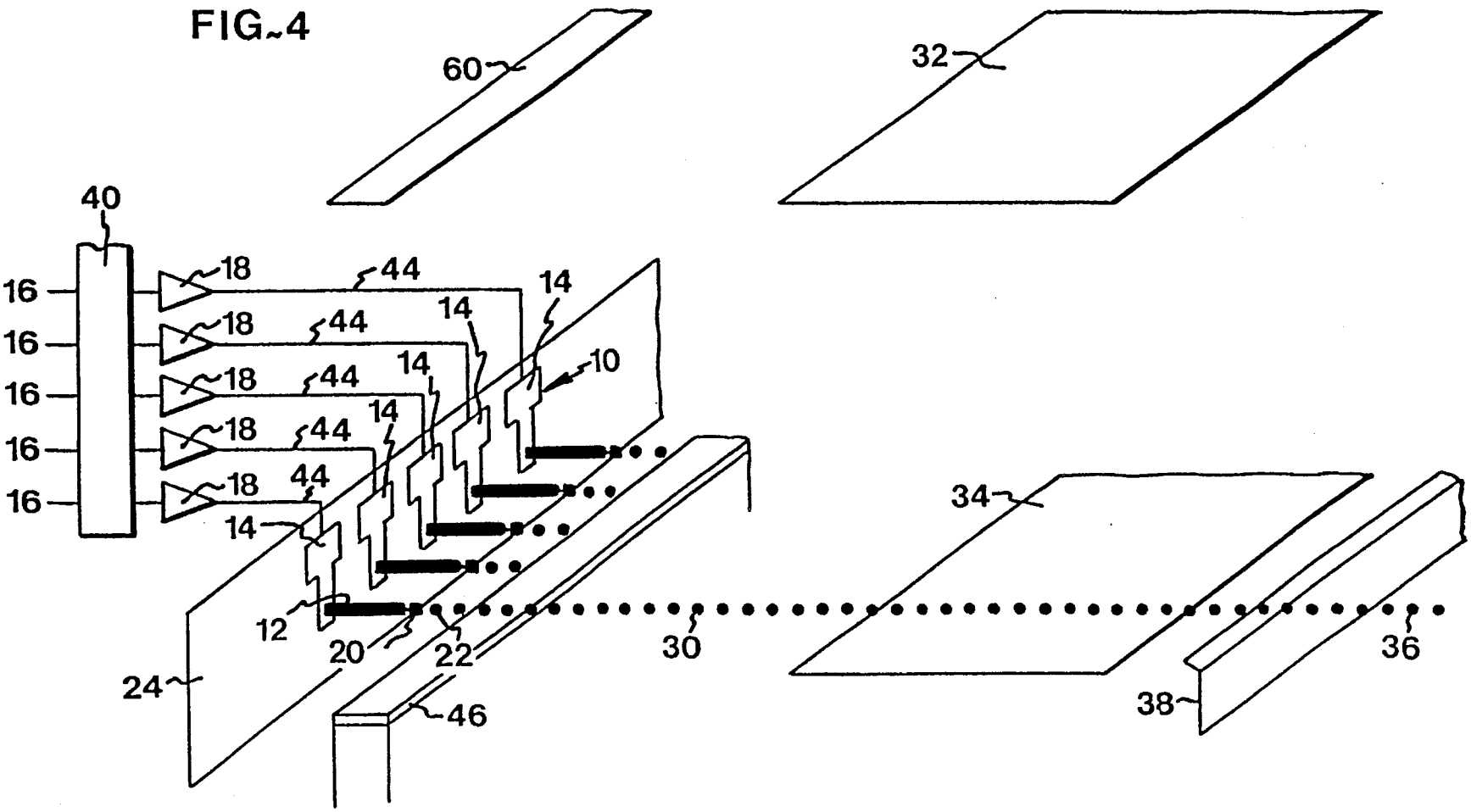
FIG. 4 is a schematic perspective view of a second embodiment of an ink jet printing head.
Figure 5:
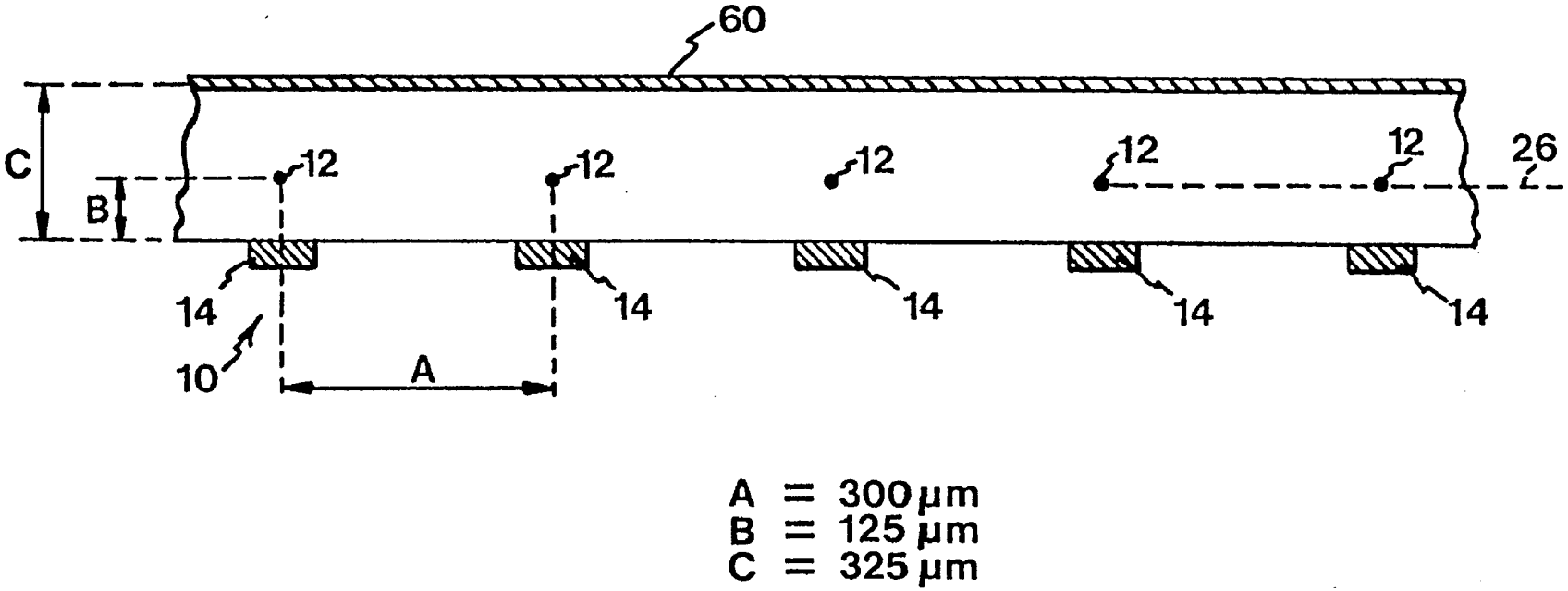
FIG. 5 is a broken-away schematic cross-sectional view of an electrode configuration in the printing head of FIG. 3, including suitable dimensions.

Before the function of the signal correction means 40 is described, reference is made to FIG. 4 which illustrates a second embodiment of a printing head. Like the printing head of FIG. 3, the printing head shown in FIG. 4 comprises a drop formation means in the form of an orifice plate 24, a charging electrode means 10 with separate charging electrodes 14, deflection electrodes 32, 34, a collecting means 38, and a signal correction means 40. In the embodiment of FIG. 4, the separate charging electrodes 14 are, however, applied directly to the side of the plate 14 facing the deflection electrodes 32, 34. Each charging electrode 14 has an orifice opposite a corresponding orifice in the plate 24. Thus, in this embodiment, the potential of the printing jets 12 discharged from the plate 24 is controlled. The separate charge fields are established between, on the one hand, the separate charging electrodes 14 and the associated printing jet 12 and, on the other hand, a common electrode 46 having a fixed potential and substantially coinciding with the main surface 28 shown in FIG. 3.

The function of the correction electronics 40 in FIGS. 2–4 will now be described with reference to FIG. 6 which at the top schematically shows a section of the charging electrode means 10 in FIG. 3.

The reference numerals in FIG. 6 are indexed X–2, X–1, X, X+1 and X+2, respectively, indicating the channel position among the channels of the printing head.

The amount of crosstalk between channels is represented by schematically drawn capacitances $C_Z$. The contribution to the charging of the drops in a specific channel X (the centre channel in FIG. 6) deriving from the charging electrode $\mathbf{14}_Z$ is given by $C_Z V_Z$ wherein $V_Z$ is the charge potential applied to the charging electrode $\mathbf{14}_Z$. It is assumed that the drops in the printing jet $\mathbf{12}_X$ for the specific channel X should be either uncharged (printing) or sufficiently charged for deflection and catching (no printing). The charge of the drops $\mathbf{22}_X$ in specific channel X is then obtained from the following equation $$Q_X = C_X V_X + \Sigma C_n V_n \ (n \neq X) \qquad \text{(equation 1)}$$

wherein $C_X V_X$ is the direct charge contribution to the drops $\mathbf{22}_X$ for the charging electrode $\mathbf{14}_X$, and wherein $\Sigma C_n V_n$ is the crosstalk contribution from the other electrodes.

Since the value of $C_{|n-X|}$ decreases when $_{|n-X|}$ increases (i.e. the farther one gets away from the specific channel X), one needs to include only so many terms that sufficient charge accuracy is obtained. If it is assumed that the system is symmetrical, the crosstalk from a given channel on one side of the channel X will equal the crosstalk from the corresponding channel on the other side, i.e.

$$C_{X-n} = C_{X+n} \qquad \text{(equation 2)}$$

To further simplify this model, it is assumed that sufficient charge accuracy for the drops is obtained if only the crosstalk from the two nearest adjoining channels on each side is taken into consideration. It should be stressed, however, that the invention is in no way restricted to this selection, and that the model is entirely generic, i.e. the number of further adjoining channels to be considered—in addition to the two nearest on each side—may be optional and should be determined by the required charge accuracy. The required charge accuracy is in turn determined int. al. by the deflection obtained by a possible "mischarge", and by the resolution desired in the printed text.

If only crosstalk from the two nearest channels on each side is taken into consideration, equation 1 may be simplified as $$Q_X = C_X V_X + C_{X+1}(V_{X+1} + V_{X-1}) + C_{X+2}(V_{X+2} + V_{X-2}) \qquad \text{(equation 3)}$$

From equation 3, $V_X$ can be calculated by iteration as follows $$V(\text{new})_X = V(\text{old})_X + K \cdot [Q(\text{ideal})_X - Q_X]/C_X \qquad \text{(equation 4)}$$

wherein $Q(\text{ideal})_X$ is the desired drop charge, $Q_X$ is the calculated value from equation 3, and K is a constant affecting the convergence of the iteration. For example, K is 0.5, preferably less than 1.0. If the iteration converges, the charge error $(Q(\text{ideal})_X - Q_X)$ will be minimised.

In a system without crosstalk, $V_X$ merely need assume two different values, viz. $V_{ON}$ to generate the drop charge 0 upon printing, and $V_{OFF}$ to generate the drop charge $Q_{OFF}$ upon deflection. According to equation 3, however, the system which has been described and which thus exhibits crosstalk, requires sixteen ($2^4$) different potentials to generate the drop charge 0, and a further 16 potentials to generate the drop charge $Q_{OFF}$, because of the necessary compensation for the crosstalk of the four nearest channels.

These thirty-two ($2^5$) different potentials will hereinafter be identified as [V(0), V(1), . . . V(30), V(31)]. The index I associated with the potentials V(I) ($\mathbf{0} \leqq I \leqq 31$) is determined as follows $$I = 2^4 Z_{x-2} + 2^3 Z_{X-1} + 2^2 Z_X + 2^1 Z_{X+1} + 2^0 C_{X+2} \qquad \text{(equation 5)}$$

wherein $Z_X$ assumes the value 0 if channel X is printing (i.e. generating uncharged drops), and $Z_X$ assumes the value 1 if the specific channel X is deflecting (i.e. generating charged drops).

The potentials calculated for the specific channel X are correct for all channels except the two outermost channels of the printing head. For these two channels either a separate calculation model must be established, or two additional channels with charging electrodes, but without associated printing jets, must be provided as outermost channels on each side.

To make the calculations manageable, the following standardisations are introduced $$"Q_X(I) = \begin{vmatrix} Q(0) & Q(1) & Q(2) & Q(3) \\ Q(4) & Q(5) & Q(6) & Q(7) \\ Q(8) & Q(9) & Q(10) & Q(11) \\ Q(12) & Q(13) & Q(14) & Q(15) \\ Q(16) & Q(17) & Q(18) & Q(19) \\ Q(20) & Q(21) & Q(22) & Q(23) \\ Q(24) & Q(25) & Q(26) & Q(27) \\ Q(28) & Q(29) & Q(30) & Q(31) \end{vmatrix} = \begin{vmatrix} 0000 \\ 1111 \\ 0000 \\ 1111 \\ 0000 \\ 1111 \\ 0000 \\ 1111 \end{vmatrix} \qquad \text{(equation 6)}$$

The value 1 corresponds to the charge which, in an equivalent system without crosstalk, is required for deflecting a drop sufficiently to ensure that it is caught. The value 0 corresponds to a zero charge.

The capacitances $C_Z$ are standardised as follows $$["C_X, "C_{X+1}, "C_{X+2}] = [1, C_{X+1}/C_X, C_{X+2}/C_X] \qquad \text{(equation 7)}$$

For the iteration, the following standardised values are given as starting values for the V(I) matrix $$"V_X = \begin{vmatrix} V(0) & V(1) & V(2) & V(3) \\ V(4) & V(5) & V(6) & V(7) \\ V(8) & V(9) & V(10) & V(11) \\ V(12) & V(13) & V(14) & V(15) \\ V(16) & V(17) & V(18) & V(19) \\ V(20) & V(21) & V(22) & V(23) \\ V(24) & V(25) & V(26) & V(27) \\ V(28) & V(29) & V(30) & V(31) \end{vmatrix} = \begin{vmatrix} 0000 \\ 1111 \\ 0000 \\ 1111 \\ 0000 \\ 1111 \\ 0000 \\ 1111 \end{vmatrix} \qquad \text{(equation 8)}$$

wherein 0 corresponds to the potential of the printing jets, and the value 1 corresponds to the potential which, in an equivalent system without crosstalk, gives sufficient deflection.

With these standardisations, equations 3 and 4 can be standardised as follows $$"Q_X = "C_X "V_X + C_{X+1}("V_{X+1} + "V_{X-1}) + "C_{X+2}("C_{V+2} + "V_{X-2}) \qquad \text{(equation 9)}$$

$$"V(\text{new})_X = "V(\text{old})_X + 0.5["Q(\text{ideal})_X - "Q_X] / "C_X \qquad \text{(equation 10)}$$

By means of equations 9 and 10, new values are calculated for all components of the matrix. By taking these new values as new input values, and by repeating the calculation, it is possible to arrive by iteration at a solution of $V_X$. Whether the iteration converges, depends upon the values of $[C_X, C_{X+1}, C_{X+2}]$, but in actual practice it has been found that the iteration converges in most cases.

The capacitance values can be measured as follows. The charging electrode systems is combined with a nozzle having but one printing jet; this channel is designated X hereinafter.

By introducing an electrically conductive plate in the path of the drop train and connecting this plate via an ammeter to the liquid forming the printing jet, the current carried by the charged drops can be measured. By applying a potential E to the charging electrode of channel Z, while maintaining all of the other charging electrodes at the same potential as the printing jets, a current $I_Z$ is measured on the ammeter. By repeating this procedure for all of the channels, a set of current values is obtained. These current values are proportional to the capacitances $C_Z$ previously mentioned. By dividing the current values by the value $I_X$, the standardised capacitances "$C_Z$ are obtained.

For the converging values of $V_X$ equation 9 can be used for calculating the drop charges given by the system. The matrix component among the uncharged conditions which has the greatest deviation from the ideal matrix (equation 6) is compared with the permissible "mischarge". If the deviation is too large, further adjoining channels must be included in the calculation, in the case here concerned also the third nearest channel on each side.

The standardised values in the V(I) matrix are converted into actual potentials by multiplying by $V_{OFF}$ for all matrix components, i.e. the potential which, in an equivalent system without crosstalk, gives sufficient deflection.

It is especially pointed out that equation 9 uses one and the same V(I) matrix for selecting the values of the variables ["$V_{X-2}$, "$V_{X-1}$, "$V_X$, "$V_{X+1}$, "$V_{X+2}$]. For the calculation in accordance with equation 9, one does not know the exact value of the potentials ["$V_{X-2}$, "$V_{X-1}$, "$V_{X+1}$, "$V_{X+2}$] because these potentials (which also have been compensated for crosstalk) also depend on the state of channels outside the channel group ["$V_{X-2}$, "$V_{X-1}$, "$V_X$, "$V_{X-1}$, "$V_{X+2}$]. This can be solved by calculating the drop charge for every conceivable situation and using a mean value in the calculation of the charge error in equation 10. In the analysis of whether adequate charge accuracy has been achieved, this should be taken into consideration.

A computer program should be formulated to carry out the large number of calculations required for obtaining $V_X$ and for analysing the "mischarge" caused by the matrix.

The above iteration technique has been used for a case in which ["$C_X$, "$C_{X+1}$, "$C_{X+2}$]=[1, 0.274, 0.032], which gave the following V(I) matrix $$V_X = \begin{vmatrix} 0.00 & 0.05 & -0.34 & -0.29 \\ 1.23 & 1.28 & 0.89 & 0.94 \\ -0.34 & -0.29 & -0.68 & -0.63 \\ 0.89 & 0.94 & 0.55 & 0.60 \\ 0.05 & 0.10 & -0.29 & -0.24 \\ 1.28 & 1.33 & 0.94 & 0.99 \\ -0.29 & -0.24 & -0.63 & -0.58 \\ 0.94 & 0.99 & 0.60 & 0.65 \end{vmatrix}$$

The values in the above matrix can be interpreted as follows. If it is assumed that all five channels are printing, i.e. situation I=0 (00000), the charge potential $V_X$ for channel X should be 0.00 according to the above matrix. If one then proceeds to situation I=4 (00100), i.e. if only the channel X is changed from printing to deflection, it will be seen that the requisite voltage change $\Delta V_X$ is +1.23. This voltage change $\Delta V_X$ of +1.23 must be carried out whenever only the channel X is changed from printing to deflection, regardless of the states of the remaining four channels. This corresponds to the following row changes in the matrix, while retaining the same column: 1 to 2, 3 to 4, 5 to 6 and 7 to 8. For example, if one proceeds from situations I=16 (line 5: 10000) to situation I=20 (line 6: 10100), the charge potential $V_X$ must be changed from 0.05 to 1.28, i.e. with $\Delta V_X$=+1.23.

If, on the other hand, it is assumed—proceeding from situation I=0 (00000)—that the nearest right-hand channel X+1 begins to deflect (i.e. a positive potential is applied to the electrode $V_{X+1}$), this will mean a change-over to situation I=2 (00010). As will appear from the above matrix, the charge potential $V_X$ of channel X must then be compensated for from 0.00 to $\Delta V_{X+1}$ by −0.34, which should be compared to the prior art technique of U.S. Pat. No. 4,074,278 in which the compensation was given as $-kV_{charge}$.

However, if one studies the compensation effect of potential changes in channels X−2 and X+2, an unexpected change of signs can be seen. For example, by proceeding once more from the charge situation I=0 (00000) and letting the next nearest channel X+2 to the right of the channel X start deflecting, which implies a change-over to the charge situation I=1, it will be seen from the above matrix that, for channel X, the voltage change required for compensation is $\Delta V_{X+2}$=+0.05. In other words, the voltage change for channel X must be positive if the next nearest channel goes from printing to deflection, and this is an unexpected result. For comparison, the compensation technique proposed by U.S. Pat. No. 4,074,278 may be studied. If one tries to use this prior art technique to compensate for more than the two nearest channels, this change of signs would not be obtained, i.e. the prior art technique proposed by this patent would not give a correct result if applied to the compensation for crosstalk from two or more channels on each side of a given channel.

According to the above matrix, the charge error for printing drops lies between 0.88% and −0.79% of the standardised deflection charge.

An interesting observation is that $V_X$ may purely be expressed additively as follows $$V_X=\Delta V_X Z_X+\Delta V_{X+1} Z_{X-1}+\Delta V_{X+1} Z_{X+1}+\Delta V_{X+2} Z_{X-2}+\Delta V_{X+2} Z_{X+2} \quad \text{(Equation 10)}$$

wherein $Z_X$ assumes the value 0 if channel X is printing (i.e. generating uncharged drops), and $Z_X$ assumes the value 1 if channel X is deflecting (i.e. generating charged drops). For example, for a change-over from situation I=(00000) to situation I=27(11011), the potential $V_X$ of the electrode $\mathbf{14}_X$ of channel X must, according to equation 10, be changed from $V_X$=0.00 to $V_X$=+1.23·0+(−0.34)·(1+1)+(+0.05)·(1+1)=−0.58, which corresponds to V(27) in the above matrix.

FIG. 7 illustrates a possible realisation of the compensation electronics for channel X with $\Delta V_{X+2}$ positive. By means of five resistors R1–R5, of which R1=R5 and R2=R4, the previously calculated table values can be realised. The printing signals from the two nearest channels X−1 and X+1 are inverted before they are coupled, like the printing signals for channel X and for the two next nearest channels X−2 and X+2, to the corresponding resistors. The output signal $\mathbf{42}_X$ from the resistor network 48 is then connected, like before, to the charging electrode $\mathbf{14}_X$ via an amplifier 18.

FIG. 8 illustrates a more generic solution. In this alternative, the function generating unit 48 comprises an electronic memory 50, such as a ROM or RAM memory, containing the previously calculated values for every conceivable input signal state. The memory 50 is addressed by the printing signals supplied in parallel and consisting for the X channel of the printing signals $\mathbf{16}_{X-2}$, $\mathbf{16}_{X-1}$, $\mathbf{16}_X$, $\mathbf{16}_{X+1}$ and $\mathbf{16}_{X+2}$. When the memory 50 is addressed in this manner, the correctly stored value is supplied in digital form, as indicated by reference numeral 52. This digital output signal can then be supplied to a digital-to-analog converter 54 converting the digital value 52 into an analog output signal $\mathbf{42}_X$ whose voltage is proportional to the binary value 52. The analog output signal $\mathbf{42}_X$ is then transferred to the charging electrode $\mathbf{14}_X$ via an amplifier 18.

It should be observed that the above-mentioned unexpected change-over of signs for the next nearest channels is not absolutely necessary. Geometries giving a negative voltage change for channel X when the next nearest channel X–2 or X+2 goes from printing to deflection, can also be physically realised.

The above method of compensating for crosstalk, according to the present invention, is so effective that it can be used with advantage in combination with a planar charging electrode structure of the type shown in FIG. 2, in spite of the fairly considerable crosstalk of such a structure. This is a considerable advantage as compared with the slitted structure which is shown in FIG. 1 and which has the above-mentioned inconvenience of clogging.

It should also be mentioned that the invention is applicable also to the case when the printing signals 16 have more than two state levels. For the above-mentioned compensation for two channels on each side of a specific channel, this would mean that the V(I) matrix contains more than 32 values. However, the calculation thereof could be carried out in basically the same manner.

I claim:

1. A method of compensating for electrical crosstalk between adjacent charging electrodes (14) in a continuous ink jet printer having multiple printing jets (12) or channels, each with one charging electrode (14), said method comprising applying, in order to provide a desired drop charge in a specific channel X, to the corresponding charging electrode ($\mathbf{14}_X$) a charge potential $V_X$ which is compensated for any charge potentials $V_{X-1}$ and $V_{X+1}$ being applied to charging electrodes ($\mathbf{14}_{X-1}$, $\mathbf{14}_{X+1}$) of the nearest channel X–1 and X+1, respectively, on each side of the specific channel X, and at least any charge potentials $V_{X-2}$ and $V_{X+2}$ applied to charging electrodes ($\mathbf{14}_{X-2}$, $\mathbf{14}_{X+2}$) of the next nearest channel X–2 and X+2, respectively, on each side of the specific channel X, said channel X, said nearest channels X–1 and X+1 and said next nearest channels X–2 and X+2 jointly forming a channel group, said compensation being achieved by selecting, for a given charge situation I of said channel group, $V_X$ as equalling a value V(I) associated with the charge situation I and included in a matrix of compensated predetermined potential values $$\begin{vmatrix} V(0) & V(1) & V(2) & V(3) \\ V(4) & V(5) & V(6) & V(7) \\ V(8) & V(9) & V(10) & V(11) \\ V(12) & V(13) & V(14) & V(15) \\ V(16) & V(17) & V(18) & V(19) \\ V(20) & V(21) & V(22) & V(23) \\ V(24) & V(25) & V(26) & V(27) \\ V(28) & V(29) & V(30) & V(31) \end{vmatrix}$$

compiled by an iterative, or equivalent, technique according to which there is calculated, in each iteration step and for every possible charge situation I of said channel group, a new value of V(I) as a function of the value of V(I) calculated in the immediately preceding iteration step and a deviation of the desired charge in the charge situation I for the specific channel X from a charge $Q_X(I)$ which, for the charge situation I, is obtained in the specific channel X according to the formula $$Q_X(I) = \sum_{i=X-2}^{X+2} C_i V_i(I)$$

wherein $C_i$ is a capacitance between the printing jet ($\mathbf{12}_X$) for the specific channel X and the charging electrode for channel No. "i" of said channel group, and wherein $V_i(I)$ is a charge potential value which, for channel No. "i" of the said channel group, is determined by means of the values of V(I) calculated in the immediately preceding iteration step.

2. A method as claimed in claim 1, characterised in that binary printing signals (16) are supplied in parallel to an electronic memory means (50) for jointly forming successive digital address signals to said memory means; that data concerning said compensated potential values V(I) for every possible combination of the binary printing signals (16), forming every possible address signal, are stored in predetermined memory spaces of said electronic memory means (50); and that charge potentials for said charging electrodes are formed based on these data, when said memory means is addressed by said address signals.

3. A method as claimed in claim 1, characterised in that printing signals (16) are supplied in parallel to a network of inverters and resistors (R1–R5) to form said charge potentials.

4. A method as claimed in claim 1, characterised in that said printing jets (12) are caused to disperse in a common geometrical plane (26), and that said charging electrodes (14) are arranged entirely outside said plane (26).

5. A method as claimed in claim 4, characterised in that said charging electrodes (14) are arranged at a surface (28) parallel to said plane (26) and facing the printing jets (12), to form a planar charging electrode structure.

6. A method as claimed in claim 1, characterised in that each charging electrode (14) is arranged in direct contact with its printing jet (12) to control the potential thereof.

7. A method as claimed in claim 1, characterised in that the said charge potential $V_X$ of the specific channel X is also compensated for in response to any charge potentials applied to charging electrodes of further adjacent channels on each side of said specific channel X.

* * * * *